US007451803B2

(12) United States Patent
Jorgensen et al.

(10) Patent No.: US 7,451,803 B2
(45) Date of Patent: Nov. 18, 2008

(54) SCREENING DEVICE AND METHOD OF OPERATING THE SCREENING DEVICE

(76) Inventors: Kent Mølsted Jorgensen, Lorents Møllers Vej 51, DK-6700 Esbjerg (DK); Ove Kold, Skolevaenget 22, Borris, DK-6900 Skjern (DK)

( * ) Notice: Subject to any disclaimer, the term of this patent is extended or adjusted under 35 U.S.C. 154(b) by 0 days.

(21) Appl. No.: 11/260,537

(22) Filed: Oct. 27, 2005

(65) Prior Publication Data

US 2006/0042766 A1 Mar. 2, 2006

Related U.S. Application Data

(62) Division of application No. 10/469,259, filed as application No. PCT/DK01/00258 on Apr. 10, 2001, now Pat. No. 7,089,991.

(30) Foreign Application Priority Data

Feb. 28, 2001 (DK) ..... 2001 00331
Feb. 28, 2001 (DK) ..... 2001 00332

(51) Int. Cl.
*E06B 9/74* (2006.01)

(52) U.S. Cl. ..... 160/310; 74/89.17

(58) Field of Classification Search ..... 160/274, 160/23.1, 24, 31, 306, 310, 267.1, 271, 265, 160/278, 284, 282, 287
See application file for complete search history.

(56) References Cited

U.S. PATENT DOCUMENTS 4,228,843 A 10/1980 Kobayashi
4,257,285 A 3/1981 Whitehouse et al.
4,472,910 A 9/1984 Iha
4,625,456 A * 12/1986 Lafontaine ..... 49/358
5,036,899 A * 8/1991 Mullet ..... 160/189
5,307,855 A 5/1994 Martensson
5,517,094 A 5/1996 Domel et al.
6,296,040 B1 10/2001 Schaap
6,484,069 B2 * 11/2002 Osinga ..... 700/275
6,719,032 B1 * 4/2004 Miers ..... 160/188

(Continued)

FOREIGN PATENT DOCUMENTS

CN 2338481 Y 9/1999

(Continued)

OTHER PUBLICATIONS

English Language Abstract for EP0668431 from esp@cnet.com.

(Continued)

*Primary Examiner*—Blair M. Johnson
(74) *Attorney, Agent, or Firm*—Turner Padget Graham & Laney, P.A.

(57) ABSTRACT

A drive apparatus includes an electrical motor, a power supply unit, a transmission mechanism, a rail part, and an encapsulating part. The drive apparatus is moveable between a first position and a second position and adjustable in these positions and in any position between these positions. The rail part and the encapsulating part are connected to each other in a heat-conducting connection. A method for operating the drive apparatus includes the steps of changing from one operational mode to another mode and subsequently moving the drive apparatus to a desired position.

7 Claims, 9 Drawing Sheets

U.S. PATENT DOCUMENTS

| | | | | |
|---|---|---|---|---|
| 7,048,029 | B2 * | 5/2006 | Rieder et al. | 160/188 |
| 7,089,991 | B2 * | 8/2006 | Jorgensen et al. | 160/310 |

FOREIGN PATENT DOCUMENTS

| | | | |
|---|---|---|---|
| DE | 2360063 | A1 | 6/1975 |
| DE | 3524361 | C1 | 11/1986 |
| EP | 0668431 | | 8/1995 |
| EP | 0677637 | A1 | 10/1995 |
| EP | 0775798 | A1 | 5/1997 |
| EP | 0838574 | A2 | 4/1998 |
| GB | 2301873 | A | 12/1996 |

OTHER PUBLICATIONS

English Language Abstract for EP0677637 from esp@cnet.com.
English Language Abstract for EP0775798 from esp@cnet.com.
English Language Abstract for DE3524361 from esp@cnet.com.
PCT International Application, WO 00/05478, Published Feb. 3, 2000, International Application No. PCT/DK99/00414 Filed Jul. 19, 1999.
English Language translation of Chinese Patent No. 2,338,481 Y dated Sep. 15, 1999.
English Language translation of Chinese Examination Report dated Feb. 4, 2005 for Chinese Application No. 01822905.0.

* cited by examiner

SCREENING DEVICE AND METHOD OF OPERATING THE SCREENING DEVICE

CROSS REFERENCE TO RELATED APPLICATIONS

The present application is a divisional application of and claims priority to U.S. patent application Ser. No. 10/469,259, filed 27 Aug. 2003, now U.S. Pat. No. 7,089,991 which claims priority to International Application number PCT/DK01/00258 filed 10 Apr. 2001, which claims priority to Danish Patents PA 2001 00331 and PA 2001 00332, both filed 28 Feb. 2001 in the Danish Patent Office, all of which are incorporated herein by reference in their entirety.

FIELD OF THE INVENTION

The invention relates generally to a screening device for screening of a building opening, a window, a door or the like. The invention also concerns a method of operation of the screening device.

BACKGROUND OF THE INVENTION

Screening devices for, e.g., screening of light, heat, noise etc. from building openings, windows, doors with windows and like workpieces, exist in manually operated embodiments and as devices driven by, e.g., electricity via e.g., an electrical motor. The former exists in versions that allow for simple retrofitting in building openings, windows, doors etc., even by non-professionals, whereas the latter versions are usually more complex in their characteristics for the major part and require the efforts of a professional during installation. In particular, this is due to the fact that these constructions involve e.g. roller blinds provided with a roll-up mechanism which is electrically driven and which is mounted in a top box. The mechanism is usually driven by a main voltage, which is one of the reason for using a professional assembler but other reasons may often be installation of control mechanisms, wiring etc.

Various devices have been suggested in which battery-driven electrical motors have worked as the drive means. Thus, it has been suggested, cf. U.S. Pat. No. 5,517,094, to mount a drive means with batteries and an electrical motor on the top box of a Venetian blind screening device, the drive means being mounted as a separate unit on the outside of the top box.

Meanwhile, there has been a desire to create a device in which the electrical drive means is not retrofitted but integrated in the screening device itself so that a more compact construction may be achieved with a larger degree of aesthetics.

This is known from, e.g., WO 00/05478 in which an electrical motor and a battery have been integrated in a bottom bar of a screening device which may be controlled via a remote control and in which the screening device is lead in a parallel guiding arrangement via two cords or strings which extend from the top to the bottom of a window in such a manner that they are led through the bottom bar in which they cross.

Since the electrical drive means is integrated in the bottom bar, which moves up and down, the energy may necessarily be supplied by a battery placed in the bottom bar in order to present a practical energy supply.

By such screening devices and drive means, which may be driven by some kind of automatism, by electricity or other means, and which may potentially be operated via remote control, it will often be problematic to operate these manually if so desired. Thus, one case may be that of attempting to push, e.g., the roller blinds up where it will be necessary to at the same time drive the drive means whereby the roller blinds are usually driven, e.g. an electrical motor, a transmission mechanism etc., and this may be complicated and inconvenient in practice.

Furthermore, in some cases, such drive mechanism may be designed as a self-locking mechanism to prevent, e.g., a drive means for roller blinds from rolling downwards to dispense the blinds due to gravity or upwards to store the blinds due to spring power, whereby the roller blinds are rolled up when the drive means allows it. In these cases, it will not be possible to push the adjustment drive manually.

As mentioned, a drive means is known from WO 00/05478, according to which an electrical motor and a battery are integrated in the bottom bar of a screening device controlled via a remote control and according to which the screening device is led in a parallel guiding arrangement via two cords or strings extending from the top to the bottom of a window in such a manner that they are led through the bottom bar in which they cross. By this construction, one embodiment introduces a self-locking mechanism which is related to the drive means while at the same time allowing for manual operation by deactivating a clutch. However, this has not been elaborated upon in the publication.

SUMMARY OF THE INVENTION

The invention concerns a drive apparatus or "drive means" including an electrical motor, a power supply unit and a transmission mechanism and methods of using the drive means. The drive means are moveable between a first position and a second position and adjustable in these positions and in any position between these positions and the drive mechanism. The component parts of the invention are simple, reliable, and economical to manufacture, assemble, and use. Other advantages of the invention will be apparent from the following description and attached drawings, or can be learned through practice of the invention.

According to an aspect of the invention, the drive means include a rail or plate part extending at least partly longitudinally with the drive means, the rail or plate part being positioned near a first outer side of the drive means, and by an encapsulating part for at least part of the drive means being placed with at least part of the surface near a second outer side of the drive means, and by the rail or plate part and the encapsulating part being connected to each other in a heat-conducting connection.

In this manner, a significant improvement is achieved in relation to one of the situations usually posing a disadvantage with drive means being placed in, e.g., a window with glass through which light and especially sun light enters, and which may result in quite high temperatures. Since the sash of, e.g., a window will set an upper limit for the volume which may be occupied by the drive means in practice, and since it will often not be possible to extend the drive means outside the plane of the frame, part of the surface of the drive means must necessarily be quite close to the glass. In this manner, this part will be exposed to high temperatures, which could damage the contents of such a drive means, e.g. electrical and electronic equipment and affect the reliability and durability of the device.

According to the invention, an effective reduction of temperatures may be achieved in an efficient manner via surprisingly few and simple components, since the damaging heat is efficiently lead away to an element with a surface facing areas with lower temperatures so that a cooling effect is obtained.

Advantageously, the drive means comprises a longitudinal support structure of which the rail or plate part forms part so that the rail or plate part essentially make up the first outer side of the drive means. In this manner, the structural construction of the drive means is utilized in a surprisingly simple manner in order to achieve the desired effect so that the use of additional material is avoided.

According to an advantageous embodiment, the encapsulating part forms at least part of a housing for the power supply unit so that efficient conduction of the damaging heat from the power supply unit takes place while having the encapsulating part serve a dual purpose as both heat-conducting means and part of the housing or cabinet.

According to a particularly advantageous embodiment, the power supply unit comprises one or more electrical batteries. Since the efficiency of a battery, and hereby the average service life, is reduced when the temperatures exceed normal operating temperatures, this embodiment will provide the effect of maintaining the durability of a given battery pack at an acceptable level which would be very advantageous in relation to the areas of use that may be provided with the invention. Thus, it is a well-known fact that one of the major problems associated with battery operation is frequent replacement of batteries which may discourage users from investing in solutions that are solely driven by batteries. By the invention, this disadvantage is avoided as it has turned out that it is possible to offer solutions which do not require replacement of batteries for a period of one year or more, even by normal use in relation to screening devices.

The encapsulating part may also form an advantageous encapsulation of other elements of the drive means whereby other advantages may be obtained such as efficient cooling of these parts as well. This may involve elements such as control circuits, electrical motors etc. that may be inherently heat-producing so that this heat may also be diverted the encapsulating part.

If the encapsulating part is at least partly manufactured in a plate material, another advantage is obtained from a manufacturing point of view whereby manufacturing costs may even be reduced.

According to yet another advantageous embodiment, the rail or plate part and the mentioned encapsulating part have been manufactured in a material with good heat-conducting properties, e.g., metals such as aluminum or other lightweight metals and/or light alloys.

If the heat-conducting connection is established, via a mechanical connection comprising, e.g., riveted joints, screw connections, welding, soldering or similar connections, deformation connections and/or glue connections and potentially the use of additional heat-conducting means such as heat-conducting paste etc., effective heat transfer between the elements is achieved in an efficient and rational manner.

According to an advantageous embodiment, a control circuit has been designed in such a manner that when the drive means is inactive, it is brought into a power-saving mode, after which tests for receipt of potential control signals are made at certain intervals and a subsequent detection of receipt of such a signal will cause the control circuit to restore the drive means to operating mode which means that yet another effect is obtained by the invention. Thus, the loss of heat from the control circuit etc. is reduced so that potentially damaging high temperatures may be avoided and/or reduced while also reducing the consumption of energy so that the effective service life, and especially the effective operating period of a battery pack, is increased which makes operation of the drive means more effective from an overall perspective.

The invention also concerns a screening device for screening of a building opening, a window, a door or the like, the screening device comprising a screening material which is rolled up, folded, gathered or the like in a first position when inactive and which is connected at its free end to a drive means moveable in relation to the first position.

In this manner, a significant improvement is achieved in relation to one of the situations usually posing a disadvantage with drive means being placed in, e.g., a window with glass through which light and especially sun light enters, and which may result in quite high temperatures in the vital parts of the drive means. Since the sash of, e.g., a window will set an upper limit for the volume, which may be occupied by the drive means in practice, and since it will often not be possible to extend the drive means outside the plane of the sash, part of the surface of the drive means must necessarily be quite close to the glass. In this manner, this part will be exposed to high temperatures, which could damage the contents of such a drive means, e.g. electrical and electronic equipment, and affect the reliability and durability of the device.

According to the invention, an effective reduction of the mentioned temperatures may be achieved in an efficient manner and via surprisingly few and simple components, since the damaging heat is efficiently lead away to an element with a surface facing areas with lower temperatures so that a cooling effect is obtained which improves the operating situation of the screening device.

According to an advantageous embodiment, the screening device is provided with a top box situated near the first position and the drive means being moveable in a plane which is essentially parallel with a plate, glass or the like in the building opening, door, the window or the like, whereby an efficient construction of a screening device according to the invention is obtained and provides the invention with a vital effect. By such a construction, an essentially closed space will be formed between the screening device and the plate or glass, the space being closed towards the bottom by the drive means/bottom bar so that significant heating of the air and the surfaces in this space may be efficiently conducted by heat conduction according to the invention to the air on the inner sides of the screening device and the bottom bar.

Advantageously, the second outer side of the drive means faces the plate, glass or the like, so that this second outer side is the one which will first and foremost receive the heat and thus most effectively be able to divert it.

According to an advantageous embodiment, the encapsulating part is placed near the plate, glass or the like, so that the heat is efficiently absorbed by it.

Moreover, the first outer side of the drive means may face away from the plate, glass or a similar element, placed in the building opening, door, the window or the like, whereby an efficient diversion of heat energy may take place.

Finally, the drive means may be moveable in relation to the first position via guide rails placed at the sides of the building opening, door, the window or the like, and the drive means may comprise drive means for cooperation with the guide rails. In this manner, any movement of the drive means may be carried out in a parallel guiding arrangement in a relatively easy manner since the drive means, e.g. drive wheels, may cooperate with the rails for transmission of operating power.

The invention also relates to a method manual operation of a drive means, and in particular a drive means for a screening device for a building opening, a door, a window or similar elements. The method including the step of moving the drive means to a desired position or at least part of it being manually adjustable from a first state to a second state, after which the drive means is moved manually to the desired position.

According to this method, it will be easy for the user to bring the drive means into a state in which the manual adjustment may be carried out. Also, this adjustment from one state to another may be constructed in such a manner that it will be clearly evident to the user and thereby make any operation of particular operator controls in a particular manner according to specific instructions superfluous.

According to an advantageous embodiment, the drive means or the at least the part of it in the first state is in a power-transmitting connection with one or more elements in relation to which the drive means may be moved via a drive mechanism, by the manual movement from the first state to the second position the method further including the step of disrupting the power-transmitting connection.

The invention also concerns a drive means comprising a drive mechanism comprising, e.g., an electrical motor and a transmission mechanism, the drive means being moveable between a first position and a second position and adjustable in these positions and in any position between these two via the drive mechanism. The drive means or at least part of it is configured to be manually adjustable from a first state to a second state, and by the drive means being manually adjustable to a desired position of the drive means in the second state.

In this manner, it will be easy for the user to bring the drive means into the state in which the manual adjustment may be carried out. Also, this adjustment from one state to another may be constructed in such a manner to be self-evident to the user and thereby make any operation of particular operator controls in a particular manner according to specific instructions superfluous. In addition, it will be immediately apparent to the user when the drive means has been brought into the mode in which the manual adjustment may be carried out.

Advantageously, the drive means or the at least part of it in the first state is in a power-transmitting connection with one or more elements in relation to which the drive means may be moved via a drive mechanism and via the manual movement from the first state to the second state, whereby the power-transmitting connection is disrupted.

In this manner, an advantageous method of switching to the mode in which the manual adjustment can be made is obtained since a relatively simple decoupling is performed of the connection between the drive mechanism and the element(s) in relation to which the adjustment of the drive means is made.

According to another embodiment, the drive means comprises a device, preferably a spring device, which will seek to bring the drive means or the at least part of it back into the first position when in the second position.

In this manner, the drive means will immediately try to return to operating mode once the desired manual adjustment has been made. Thus, the only action required is letting go of the drive means after which it will return to normal operation mode.

Advantageously, the drive means comprises a longitudinal support structure with means at its ends for cooperating with the element(s) in relation to which the drive means is moveable via a drive mechanism, the means for cooperation comprising means whereby the power-transmitting connection may be disrupted.

In this manner, a particularly advantageous embodiment of the invention is obtained, wherein the disruption of the power-transmitting connection is applied at one or both ends of the drive means so that the remaining part may be manufactured in one coherent piece and so that the relative movement to be carried out is limited to a relatively small part of the length of the drive means. In this manner, a stable and durable construction is achieved.

According to a further embodiment, the drive means cooperates with the guide rails placed at the sides of the building opening, door, window or the like, and the drive means comprises drive means by which power may be transferred to the guide rails.

In this manner, the transfer of power is made in a simple and elegant manner whereby the means may at the same time serve as guide rails for, e.g., parallel movement.

Advantageously, the drive means comprises means, which will engage with at least one of the guide rails when the drive means is affected in a direction essentially perpendicular to the movement of the drive means between the adjustable positions, whereby the power-transmitting connection is disrupted.

In this manner, manual operation can take place simply by pressing down on part of the front of the drive means, preferably the upper part. This may be done at any location along the entire length, but it is preferable to have a special finger grasp or the like on which pressure may be exercised, e.g. near the center of the drive means. By including such a finger grasp or the like, the place in which to exercise manual operation will be obvious to the user.

Furthermore, the invention concerns a screening device for screening of a building opening, a window, a door or the like, the screening device comprising a screening material which is rolled up, folded, gathered or the like in a first position when inactive and which is connected at its free end to a drive means moveable in relation to the first position.

Finally, the invention relates to a fitting for use during transportation and mounting of a drive means and/or a screening device, the mounting fitting comprising means for fixing a top box and a bottom bar relatively positioned and the mounting fitting also comprising means to ensure that the drive means is fixed in the second mode, whereby the power-transmitting connection is disrupted.

In this manner, mounting of a drive means or a screening device according to the invention can surprisingly be carried out without any difficulty. Such difficulties could easily be anticipated when bringing the element(s) with which the power-transmitting connection is to be made into contact with the drive means. By presetting the drive means in a mode in which the power-transmitting connection is disrupted, the element to which power is to be transferred during operation may easily be mounted to the drive means or vice versa. Thus, the invention is simple and user-friendly.

BRIEF DESCRIPTION OF THE DRAWINGS

The above and other aspects and advantages of the present invention will be described in the following detailed description with reference to the figures in which.

DETAILED DESCRIPTION OF THE INVENTION

Figure 1:
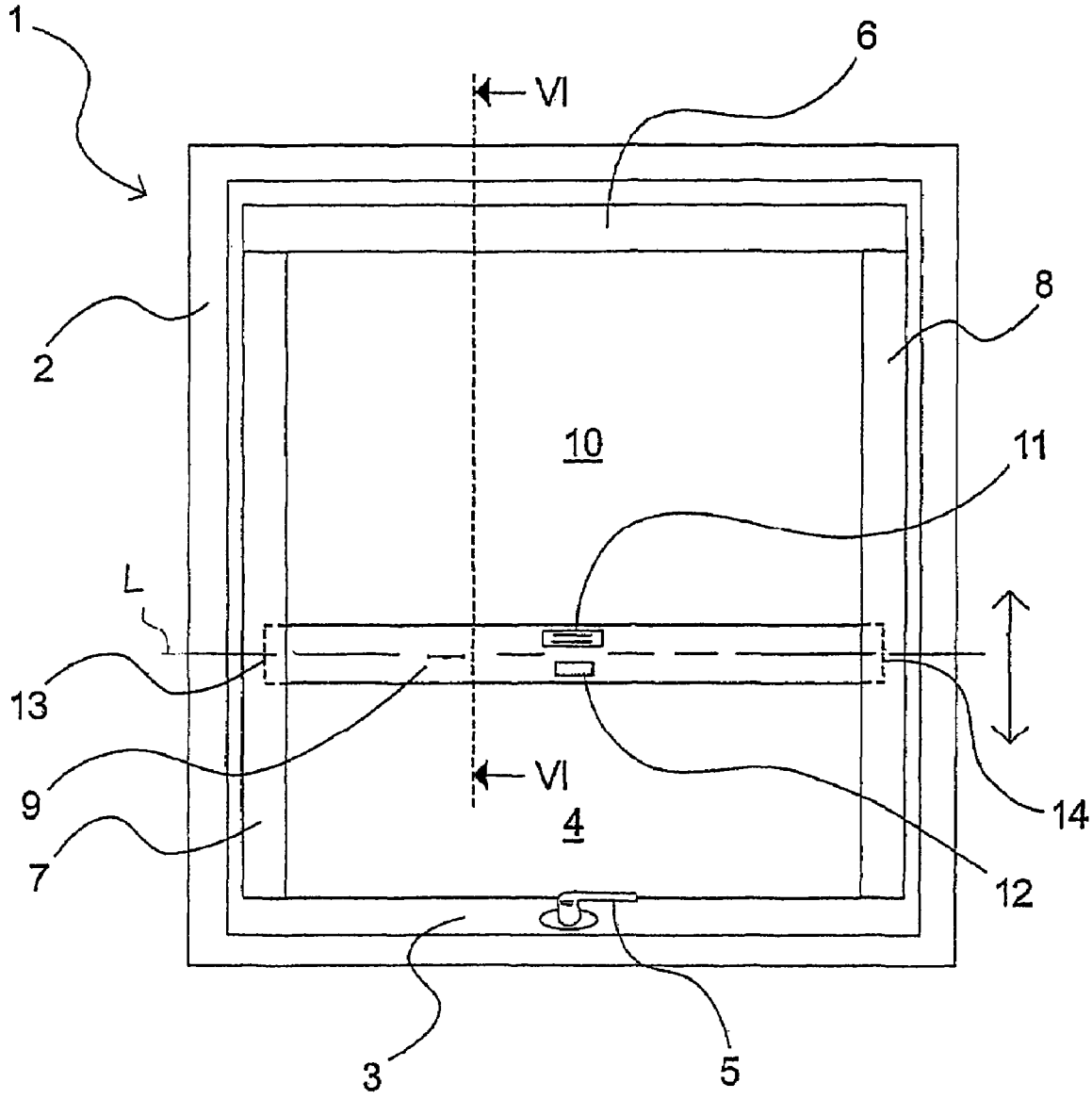
FIG. 1 is an elevational view of an inside (front) of a window in which a drive apparatus and a screening device according to an embodiment of the invention have been mounted.

Detailed reference will now be made to the drawings in which examples embodying the present invention are shown. The drawings and detailed description provide a full and detailed written description of the invention, and of the manner and process of making and using it, so as to enable one skilled in the pertinent art to make and use it, as well as the best mode of carrying out the invention. However, the examples set forth in the drawings and detailed description are provided by way of explanation of the invention and are not meant as limitations of the invention. The present invention thus includes any modifications and variations of the following examples as come within the scope of the appended claims and their equivalents.

The detailed description uses numerical and letter designations to refer to features in the drawings. Like or similar designations in the drawings and description have been used to refer to like or similar parts of the invention.

FIG. 1 shows a window, generally referred to as 1, seen from the inside, the window being provided with a light screening device designed according to an embodiment of the invention.

The window 1 comprises a commonly known frame 2 carrying a sash 3. This sash 3 comprises a glass 4, and if it can be opened, the frame 2 and the sash 3 will also feature means for opening such as hinges and as illustrated, a closing handle 5.

At the top of the window 1, a top screening box 6 has been mounted on or in the sash 3 and, rails 7 and 8, respectively, have been mounted or shaped in the side sections of the sash 3. These rails 7,8 have been designed in such a manner that they serve as guides for a bottom bar 9 which may be moved up and down as illustrated by the arrow between the lower edge of the window and the top box 6 and to any given position in between these limits.

The bottom bar 9 is connected to a screening device 10, which extends between the bottom bar 9 and the top box 6. This screening device 10 may be designed in a number of ways such as, e.g., a pleat cloth, but it may also involve a cloth as illustrated to be wound up on a spring-based roller (not shown) placed in the bottom bar 9 or in the top box 6. In the detailed example illustrated in the following, the cloth will preferably be rolled onto a spring-loaded roller in the top box 6 similar to known roller blinds.

The screening device 10 may be designed in various materials and may have various properties depending on its specific purpose, e.g., as a light screening device from, e.g., incoming sun light. Thus, the cloth may be completely transparent but have a light-filtrating effect or it may be a cloth with less or more screening properties, i.e. any given degree of transparency, potentially chosen according to particular light spectrums or the cloth may serve to completely shut out any incoming light, such as a blackout curtain.

As mentioned, the rails 7 and 8 are designed in such a manner that they may guide the bottom bar 9 during movement and for this purpose, the bottom bar 9 has been provided with means at both ends, 13 and 14 respectively, for cooperation with the rails 7 and 8 which includes the transfer of driving force between the bottom bar 9 and the rails 7 and 8 as will be described in detail at a later point.

The bottom bar 9 further comprises means for driving the bottom bar, the means for driving being controllable, e.g., wirelessly transferred signals, e.g., from a remote control, the signals being intercepted by a receiver 12, e.g., a receiver of infrared or RF signals, the receiver 12 being located at front of the bottom bar 9 as shown. Also, this may be provided with an operating grip 11 for manual control of the screening device 10, the operating grip 11 and its function being described in detail below.

Figure 2A:
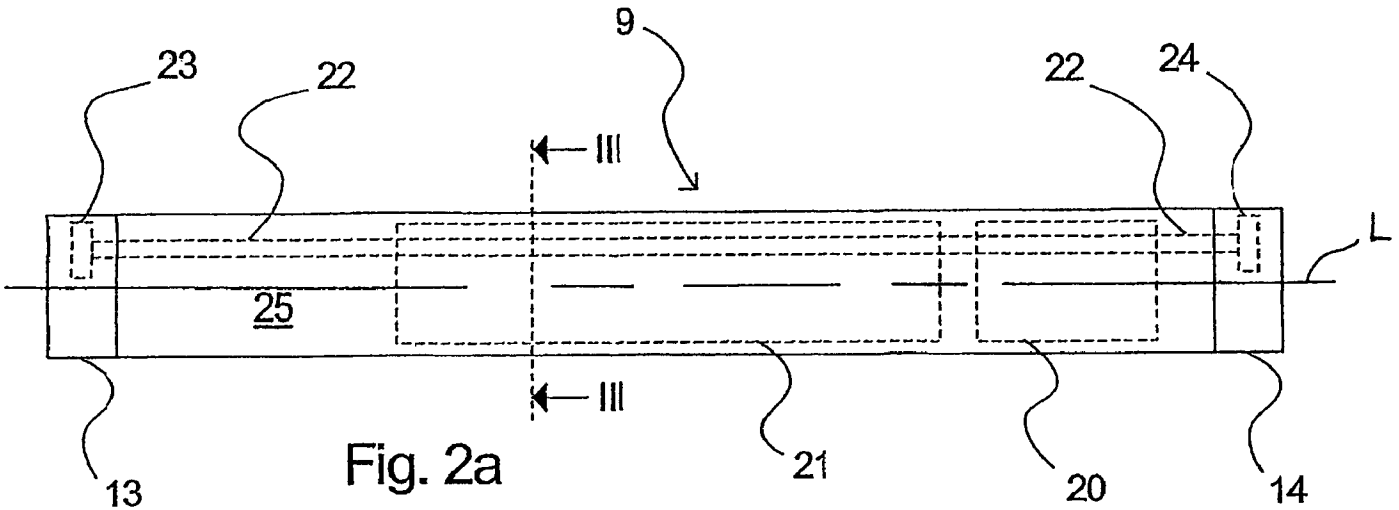
FIG. 2*a* is a front elevational view of a drive apparatus according to an embodiment of the invention.

FIG. 2*a* shows a bottom bar 9 from the front, i.e. in the same direction as in FIG. 1, with select features illustrated. As shown, the bottom bar 9 comprises at least one drive mechanism 20, which may comprise one or more electric motors, preferably DC motors, driven by power from a power supply unit 21. This power supply unit 21 will preferably be in the shape of a battery pack 37 which may comprise one or more rechargeable or non-rechargeable batteries, the battery pack 37 being described in detail at a later point. The drive mechanism 20 may furthermore comprise a transmission mechanism which may be integrated in the electric motor by which a driving force may be transferred to one or more drive wheels 22, potentially a passing shaft, which may in turn transfer the driving force to driving means 23 and 24, respectively. These driving means, preferably in the shape of drive shafts, are placed at each end of the bottom bar 9, i.e. in immediate proximity of means 13 and 14, for cooperation with the rails 7 and 8, respectively. It is obvious that more than one driving mechanism 20 may be placed in a bottom bar, for example, one at each end, the driving mechanisms being controllable in relation to each other, including being synchronized in relation to each other, but e.g. also in such a manner that rolling the screening up and down in non-rectangular windows, such as trapezoid or half-arched windows, may take place as well.

As shown in FIG. 2*a,* the means 13 and 14 for cooperation with the rails 7,8 are designed as separate parts attaching with a longitudinal rail or plate part 25, which runs in a longitudinal direction substantially parallel to a longitudinal axis L of the bottom bar 9 and which essentially extends in the entire height of the bottom bar 9 as shown. This rail or plate part 25 may thus form a basic part or a structural part of the bottom bar 9 and the components of the bottom bar 9, such as the power supply unit 21, the drive mechanism 20, the suspension of drive shaft(s) etc., may be mounted either directly onto the plate or rail part 25 or indirectly though fastening means, fitting, housing parts or the like to the plate or rail part 25.

Figure 2B:
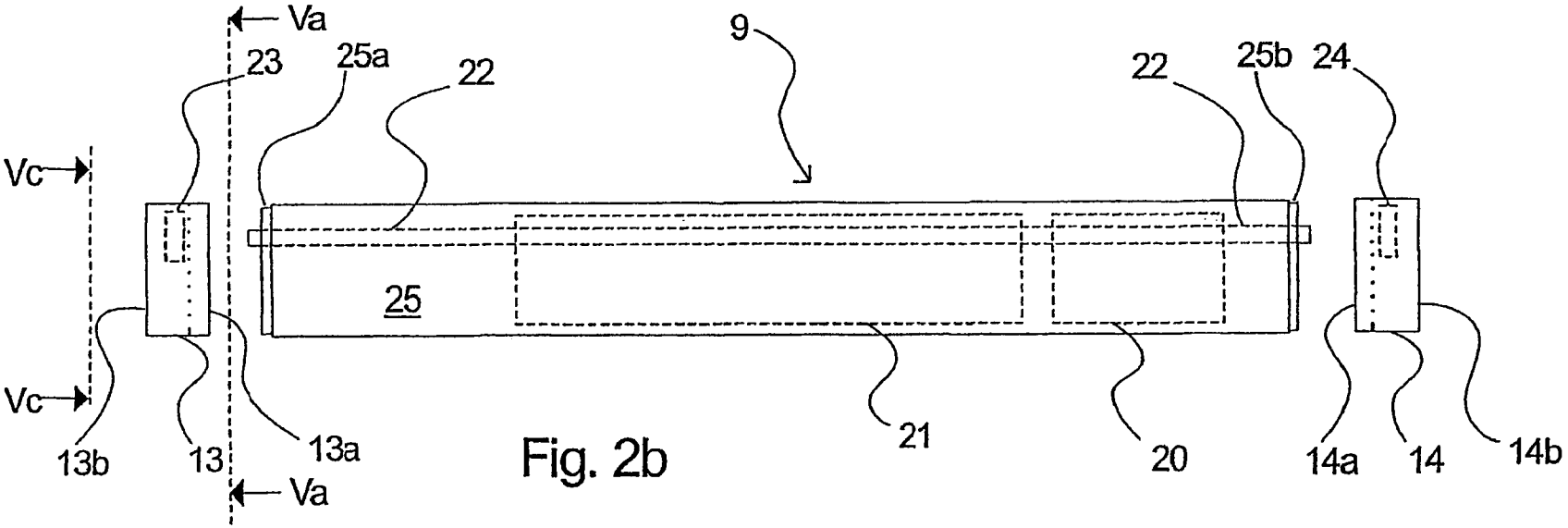
FIG. 2*b* is an exploded view similar to the embodiment of FIG. 2*a;*

As mentioned, the means 13 and 14 for cooperation with the rails 7,8 are designed as separate parts as shown in FIG. 2*b* in which the means 13 and 14 have been moved away from the plate or rail part 25. As can be seen, the plate or rail part 25 has been designed with means 25*a* and 25*b*, respectively, for mounting and/or fastening of drive means 13 and 14, e.g. end or flange parts as illustrated, which may be pushed into corresponding slots, grooves and/or support parts designed on the means 13 and 14 in such a manner that a sufficiently rigid connection between the parts is obtained.

Furthermore, these controls 25*a* and 25*b* and/or the corresponding parts on the means 13 and 14 for cooperation with the rails 7,8 may be provided with locking means, e.g. in the shape of snap locks or the like, so that the means 13 and 14 are fastened to the remaining part of the bottom bar 9, especially the plate or rail part 25.

As illustrated, the drive means 23 and 24, which may be designed as drive wheels as already mentioned, are carried in the corresponding means 13 and 14, respectively, for cooperation with the rails 7,8 in such a manner that the drive means 23 and 24 are removed with the respective means 13 and 14. This can be obtained by letting the ends of the drive shaft or axles 22 be releasably connected to the respective drive wheels 23 and 24 as shown in FIG. 2*b*. Alternatively, the drive shafts, if there is more than one, may be fixedly connected to the drive wheels and releasably connected to one of the other parts of the transmission system. The power-transmitting releasable connection between the axle/axles and the other parts, such as the drive wheels, may e.g. be designed as a key and slot connection or by the axle pivots being designed with one or more straight edges, potentially polygonal in shape, and the axle holes in the drive wheels being in a corresponding design.

As shown by the dotted line in FIG. 2*b*, the means 13 and 14 for cooperation with the rails 7,8 may be divided into an inner part, 13*a* and 14*a* respectively, and an outer part 13*b* and 14*b* respectively, in which the drive means 23 and 24, respectively, may be carried in the outer parts 13*b* and 14*b*, respectively, while the inner parts 13*a* and 14*a* respectively, serve as a connection of the means 13 and 14 cooperating with the rails 7,8 with the other part of the bottom bar 9, and especially with the plate or rail part 25. Furthermore, the outer parts 13*b* and 14*b* may be designed with means for control in relation to the rails 7 and 8, e.g. with control surfaces or the like. These parts will be described in detail at a later point.

Figure 3A:
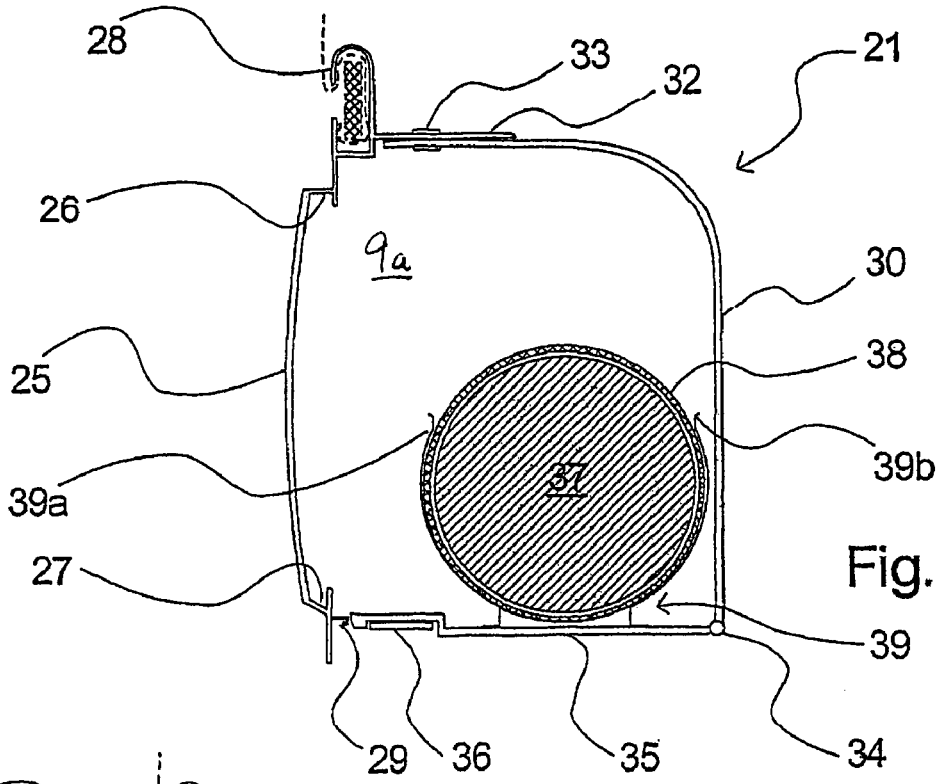
FIG. 3*a* is a cross-section of the drive apparatus in FIG. 2*a* along the line III to III.

FIG. 3*a* shows a large-scale cross-section of the bottom bar 9 in FIG. 2*a* taken along the line III-III so that the power supply unit 21, among other things, may be seen most clearly. Thus, the longitudinal plate or rail part 25 is shown with edge parts 26 and 27 in the upper and lower parts on the inside for fixation of the components to the plate or rail part 25. At the top, the part 25 is provided with a profile part 28 which may serve to fasten the screening material, e.g. a cloth, to the bottom bar 9, since a bending of the end of the cloth around a bar or strip may be displaced in the sideways direction into the profile part 28 so that the end of the cloth is fastened herein as illustrated by the dotted lines in FIGS. 3*a* and 3*b*. At the bottom, the part 25 features en profile part 29 which may serve as a means of fixation of a sealing strip (not shown) which may engage with a frame part of the window so that a complete screening, even between the bottom bar 9 and e.g. the lower part of a window, may be achieved.

An encapsulating plate 30 forms the back wall and top of the bottom bar since this encapsulating plate may extend in the entire length of the power supply unit or potentially longer so that the entire bottom bar is encapsulated by this plate 30. However, it is also possible to use several separate encapsulating plates which may extend in tandem with each other along the bottom bar 9. In the shown embodiment, the encapsulating plate 30 extends at a length essentially corresponding to that of the power supply unit 21, and will be ended by end plates (not shown) extending up along the inside of the plate or rail part 25 and potentially fastened onto this.

At the upper part, the encapsulating plate 30 is fixed to a flange 32 on the plate or rail part 25, e.g., via rivets as illustrated. Other methods of fixation may be applied, which will be described later on, since this may involve a heat-conducting connection, as will also be described later on. The lower part of the encapsulating plate 30 has been provided with a hinge part 34 whereby the encapsulating plate 30 is connected to a bottom flap 35. This bottom flap 35 attaches to the profile part 29 so that an inside cavity is formed in the bottom bar. The bottom flap 35 is furthermore provided with locking means 36 that may comprise one or two closing latch displaceable in the longitudinal direction as illustrated, which may be displaced in a groove in the bottom flap 35 so that it/they may (dis)engage with corresponding locking means at the end(s) of the power supply unit 21, e.g. designed on or in the above-mentioned end plates.

Finally, the purpose of the bottom flap 35 is to carry a battery pack or power supply package 21 comprising an appropriate number of batteries 37, e.g. four size D batteries, which may be positioned in a tubular piece 38 of e.g. a cardboard material. In this manner, it will be possible to arrange a number of batteries 37, e.g. type D, in continuation of each other in the tubular piece 38 which is shorter in length than the total length of the batteries, after which the battery pack 21 may be placed in retainers and/or terminals. As shown, an essentially U-shaped retainer comprising two legs 39*a* and 39*b* may be placed on the bottom flap 35, the retainer 39 being designed according to prior art in a light resilient material. Preferably, two such retainers 39 may be placed on the bottom flap 35 at a distance of less than the total length of the battery pack 21. Alternatively, the tubular piece 38 may have a length which is less than the distance between the two retainers 39 so that the legs 39*a* and 39*b* of the two retainers clasp onto the outer casing of the battery pack 21 whereby the tubular piece 38 solely serves to position the batteries 37 in relation to each other. Flexible electrical terminals (not shown) may be placed conventionally at the ends of the battery pack 21 for establishment of an electrical connection with the end poles of the battery pack, the terminals being connected to the electrical circuit via flexible wires. Other embodiments are also possible such as integration of battery retainers and electrical terminals in single units.

Figure 3B:
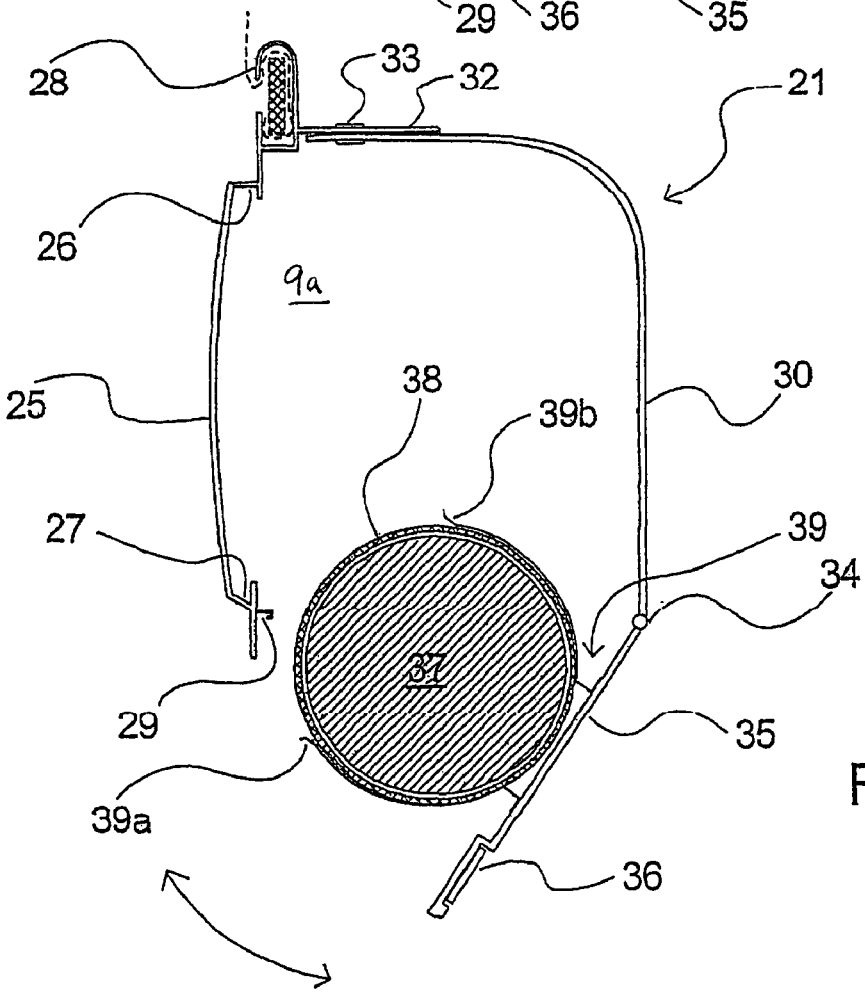
FIG. 3*b* is a view similar to FIG. 3*a* particularly showing a bottom flap opened.

As shown in FIG. 3*b*, the bottom flap 35 may be opened in a downwards direction once the closing means 36 is operated, and the power supply unit 21 is dimensioned in such a manner that the battery pack 37 may pass freely by, e.g., the profile part 29 so that the battery pack 37 may easily be removed or inserted when the bottom flap 35 is turned all the way down.

In connection with the use of a drive means according to the invention for windows, doors or similar building openings, and even if placed at a certain angle in relation to the vertical direction, this embodiment is particularly advantageous since it is only necessary to activate the closing means 36 after which the bottom flap 25 with the battery pack will open downwards due to gravity. Thus, the battery pack 21 will be immediately visible and accessible for handling, just as reassembly of the battery pack 21 subsequent to potential replacement of the batteries 37 and the closing of the bottom flap 35 will be easy for the user.

Figure 4A:
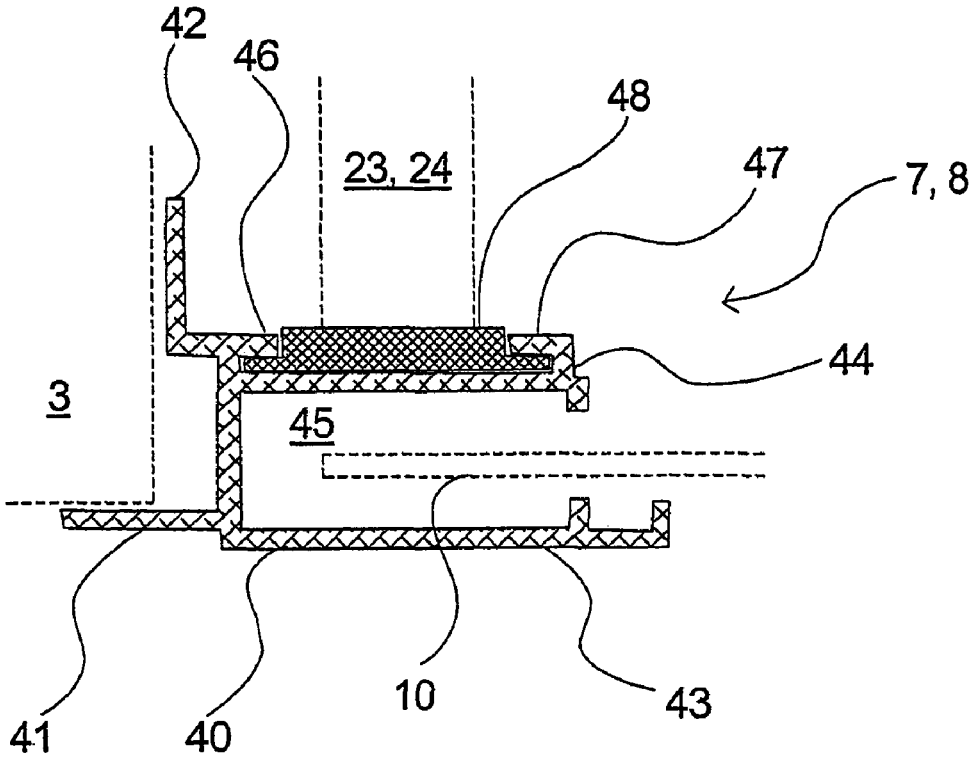
FIGS. 4*a* & *b* are sectional and a perspective views, respectively, of a drive rail for use in connection with an embodiment of the invention.
Figure 4B:
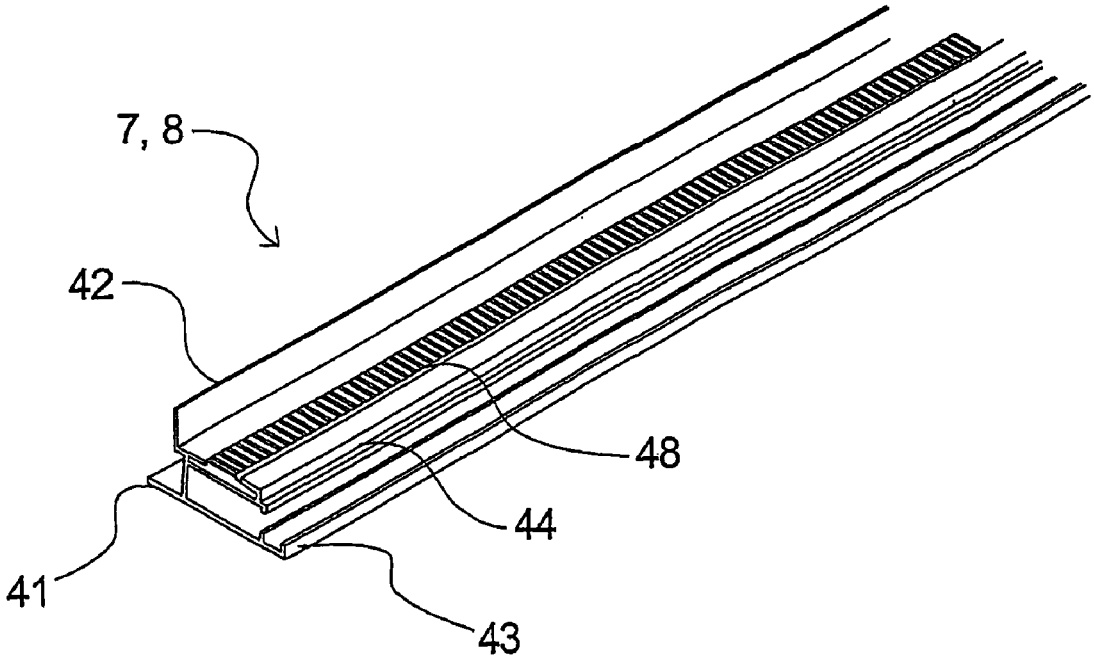

One embodiment of a rail 7 or 8 for use in connection with an embodiment of the invention will be described in the following with reference to FIGS. 4*a* and 4*b*, in which FIG. 4*a* shows a large-scale cross-section of a rail 7,8 while FIG. 4*b* shows a perspective view of a corresponding rail.

As shown in FIG. 4*a*, the rail comprises a profile part 40 which may be manufactured in an appropriate material such as wood, potentially a metal such as aluminum, or of a plastic material or a composite material. On the one side, the profile part 40 features a sideways flange 41 and an essentially perpendicular flange 42 thereupon. These two serve for positioning of the rail in relation to e.g. the corner of a sash 3 as indicated. On the other side, the profile part 40 features a protruding part 43 extending basically in parallel with a second protruding part 44 so that a space 45 is formed between these two parts. As indicated, this space 45 will be used to receive the lateral edges of the screening material 10 when moved up and down so that screening of the sides of e.g. a window or a door will be complete.

The upper side of the protruding part 44 has been designed with inwards hooking parts 46 and 47, so that a means 48 configured to transfer the driving force to the rail by, e.g., a drive wheel 23 and 24 as described, may be fastened in the profile part 40. In FIG. 4*b*, this means 48 is illustrated by a rail, strip or ribbon-shaped means provided with transverse ribs, teeth or the like, e.g., be designed as a toothed bar which, in turn, may be divided into several smaller sections assembled into a coherent unit. For cooperation with this rail, strip or ribbon-shaped means, the drive means 23,24 may, e.g., be provided with drive wheels, coated drive wheels with a coating which corresponds with the rail, strip or ribbon-shaped subject, drive wheels shaped as toothed wheels or the like. The rail, strip or ribbon-shaped means 48 may be designed in any appropriate material such as e.g. a plastic material or another synthetic material. Furthermore, the rail, strip or ribbon-shaped means 48 may be positioned in the longitudinal direction of the profile part 40, if necessary, by e.g. a mechanical lock, deformation of, e.g., one or both of the hooked parts 46, 47, potentially in one or more spots, or by other means such as gluing or the like.

Other embodiments of the rail, strip or ribbon-shaped subject 48 and/or drive means 23,24 are possible, just as the design of the profile part 40 allowing for other forms of power transfer to be conducted falls within the scope of the invention.

The profile part 40 may, e.g., be designed in such a manner that a surface or a part hereof is designed with such power transfer in mind that a separate unit for this purpose may be avoided. Furthermore, it should be apparent that the two units may be manufactured in one single body if the profile part 40 and the means 48 are produced from the same material.

In the following, the inner 13*a*, 14*a* and the outer 13*b* and 14*b* means for cooperation with the guiding rails 7,8 will be described in detail with reference to FIGS. 5*a* to 5*d*, including especially the associated function allowing manual operation of a drive means according to an embodiment of the invention.

Figure 5A:
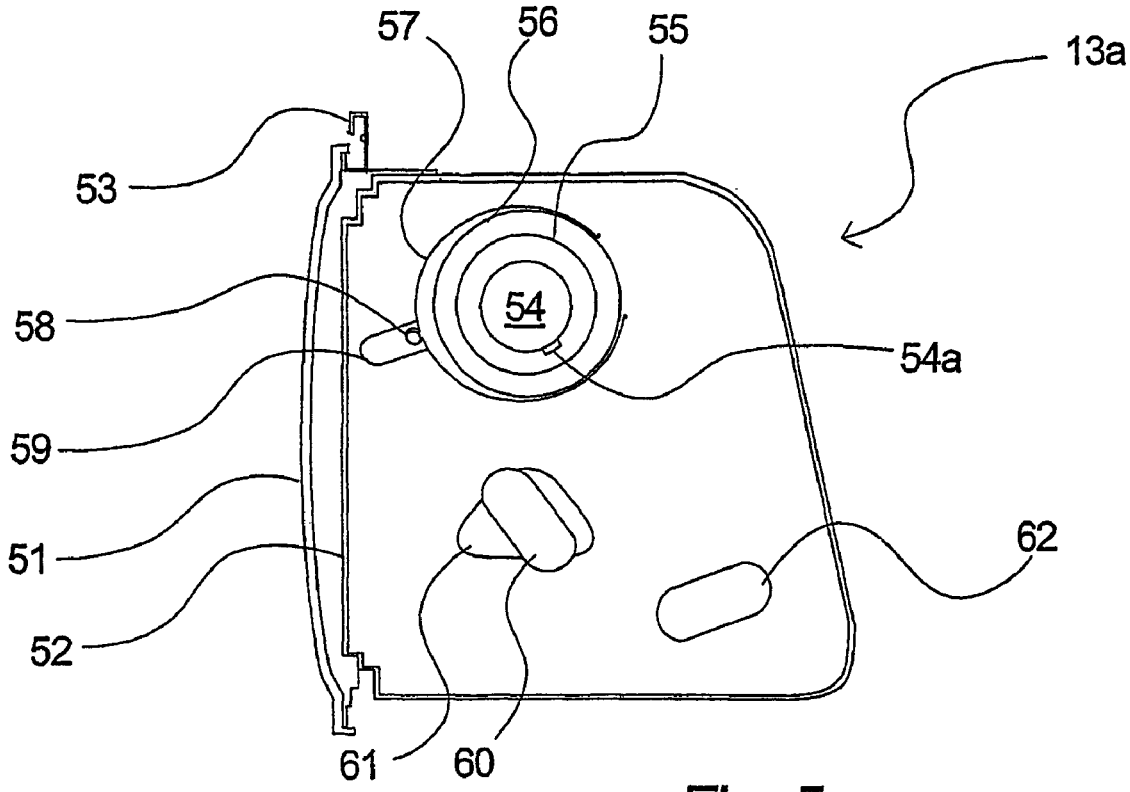
FIGS. 5*a* to *d* are side elevational views of embodiments of inner and outer means for cooperation with guide rails taken along the line Va-Va and the line Vc-Vc, respectively, shown in FIG. 2*b;*
Figure 5B:
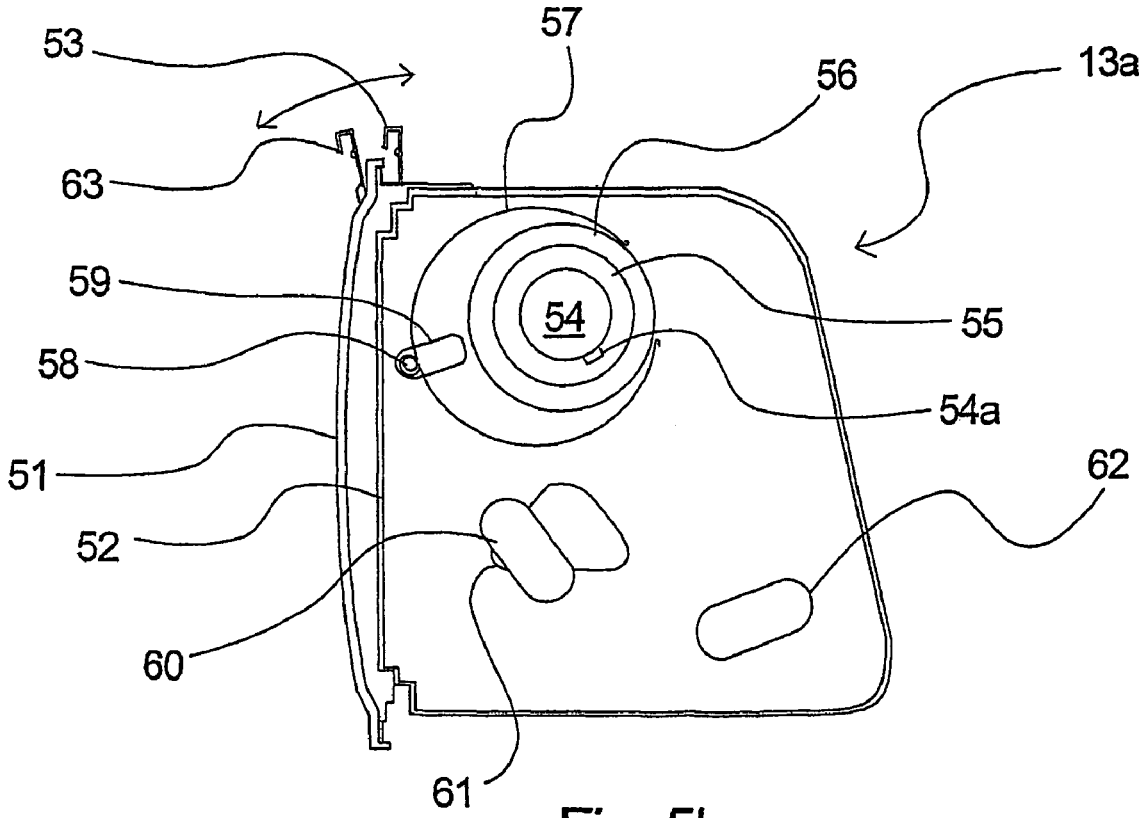

FIGS. 5*a* and 5*b* show an embodiment of the invention for an inner part, e.g. 13*a*, as it will appear from the plate or rail part 25 while at the same time showing an outer part 13*b* mounted to the inner part 13*a*. As illustrated, one of the sides will feature upright edge parts 51 that will form means for mounting on the plate or rail part 25 together with an encompassing upright edge part 52, e.g., via its means 25*a*. Furthermore, the top shows a profile part 53 which may fix the lower edges of a cloth or the like in a manner similar to that of the profile part 28 shown in FIG. 3

The inside of the inner part features an axle hole 54 going through an axle stub 55 which, in turn, is carried in an axle bearing 56 going through the inner part of 13*a*. As previously mentioned, the axle hole 54 is configured to ensure a power-transmitting connection with a drive shaft 22, e.g., via a groove 54*a* in the shown embodiment.

It should be understood that an outer part 13*b* will be present immediately behind the shown inner part 13*a* and that this outer part 13*b* will partly be connected to the inner part 13*a* via a pin 58 which is moveable in a slot in the inner part 13*a* via a locking pin 60 mounted through a corresponding locking hole 61 in the inner part and via a turning pivot (not shown) embedded in a recess (seen from the other side of the inner part 13*a*) or an opening 62. Thus, it can be seen that it will only be possible to turn the outer part 13*b* at a certain angle in relation to the inner part 13*a* around a center of rotation situated close to the recess 62 and/or the lower parts of the inner part 13*a*.

Thus, in FIG. 5*b*, the outer part 13*b* has been turned at maximum angle in relation to the inner part 13*a*. In this manner, a profile part 63 meant for fixation of the lower part of the cloth 10 and forming part of the outer part 13*b* can be seen. Furthermore, it can be seen that a return spring 57, shown in FIG. 5*a* and carried by the pin 58 with legs designed as essentially circular periphery pieces extending around the axle bearing 56, will exercise a force against the turning of the inner and the outside parts 13*a*,13*b* in relation to each other and will seek to bring the two parts 13*a*,13*b* back into their initial positions. As shown in FIG. 5*b*, the return spring 57 will be pulled away from the axle bearing 56 by the pin 58 once the inner and outer parts 13*a*,13*b* are turned in relation to each other while the legs of the return spring 57 will be pressed away from each other by the stub-shaped axle bearing 56. Furthermore, it can be seen from FIG. 5*b* that the locking pin 60 in this position would be moved over to the other side in the corresponding locking hole 61.

The return spring 57 can be designed other than as illustrated. For example, it would be possible to use leaf springs, helical springs shaped as pressure or tension springs, hairpin springs etc. Furthermore, it would be possible to use springs with different characteristics depending of the manner in which the drive means has been mounted, i.e. the angle at which it is mounted in relation to the vertical direction. If the mounting involves a strongly inclined position, the requirements to the spring power would not be as high as with a more vertical mounting since gravity at an inclined position will assist in bringing the drive means back to its power-transmitting position. Also, it would be a great advantage in relation to strongly inclined mounting to have relatively limited spring force against which the drive means must be moved into another position allowing for manual operation since the spring force must be defeated by the user while also defying gravity. Operation will therefore be easier while at the same time maintaining the ability of the drive means to return to operational mode without problems. Furthermore, an adjustment or presetting device may be attached so that the spring force may be varied in relation to the mounting positions in question.

Figure 5C:
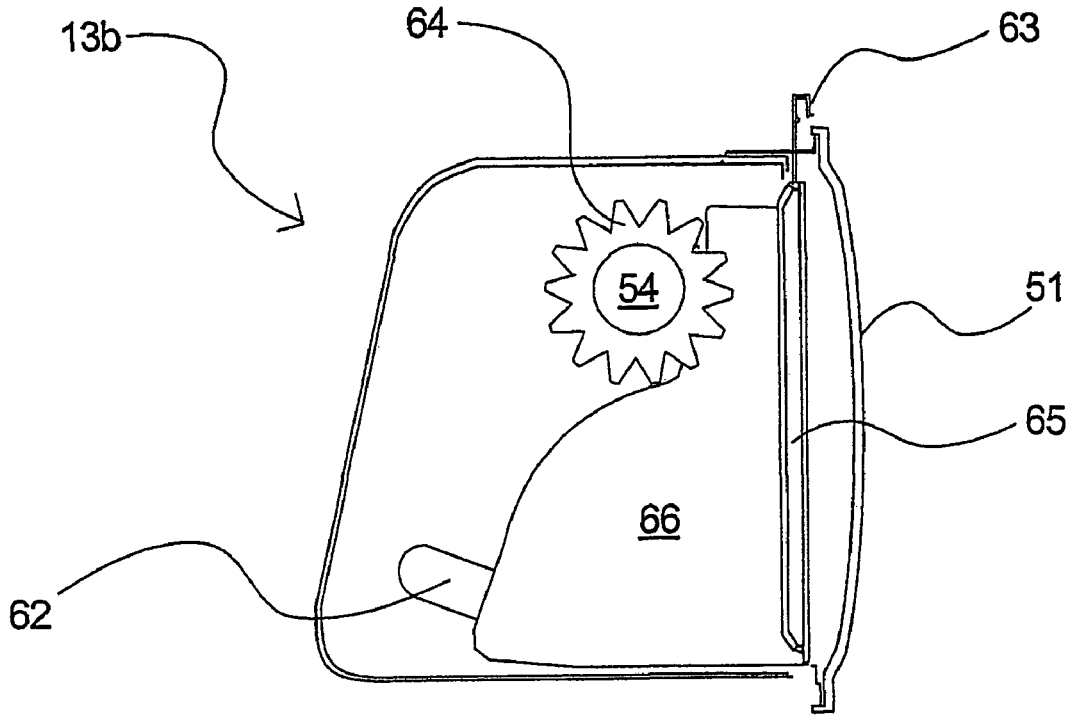
Figure 5D:
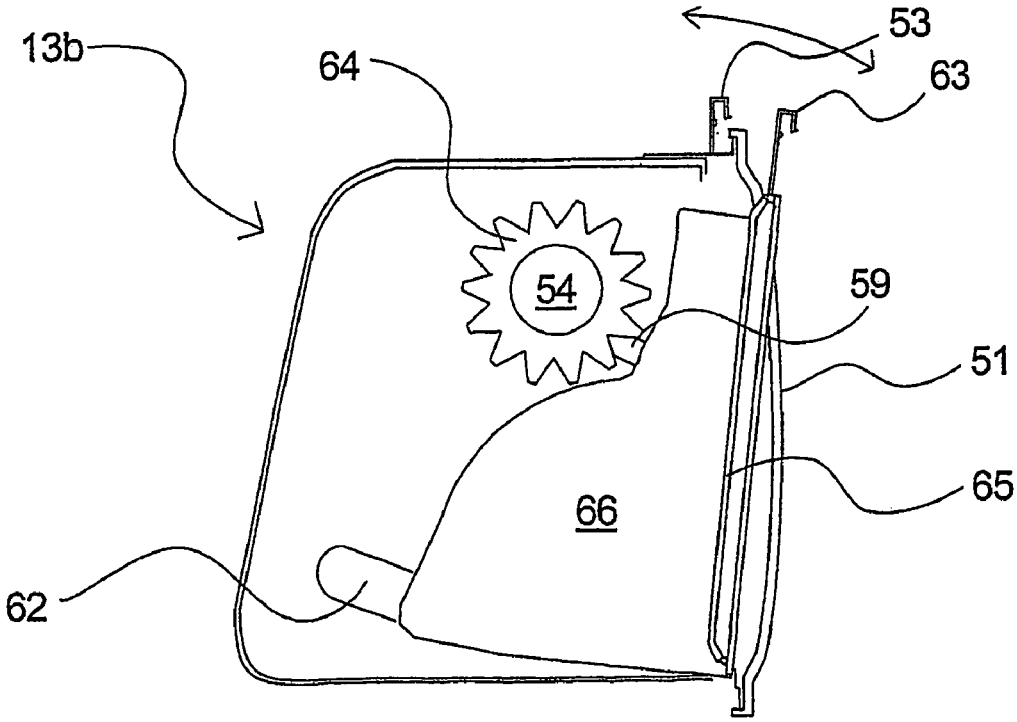

FIGS. 5*c* and 5*d* correspond to FIGS. 5*a* and 5*b*, since FIG. 5*c* and 5*d* show the outer parts, e.g. 13*b*, seen from the outside with the corresponding inner parts being mounted behind them. As is illustrated, the outer part 13*b* will feature a pivotal body 66 with upright parts 65 which form the guiding parts as will be explained later. The upper part of these parts 65 has been provided with the previously mentioned profile part 63 and it should be understood that the parts engaging with the inner part, such as a pivot engaging with the recess 62, the locking pin 60 and the pin 58, will be connected to the back of the pivotal body 66. FIGS. 5*c* and 5*d* also show a passing axle hole 54 and the axel stub 55 (shown in FIGS. 5*a* and 5*b*) will be connected to a drive wheel in the shape of a toothed wheel 64 as is also shown.

By turning the pivotal body 66, the guiding surfaces 65 will be moved away from the toothed wheel 64 and, as can be seen, thereby make the previously mentioned slot 59 accessible between the toothed wheel 64 and the body 66 which will be utilized later.

As will be understood, the toothed wheel 64 will engage with a guide rail 7 or 8, such as the rail, strip or ribbon-shaped means 48 shown in FIG. 4, since the guiding surfaces 65 will be located in the space 45 between the protruding parts 43 and 44 and at the same time ensure that the toothed wheel 64 will engage with the toothed bar when the situation illustrated in FIG. 5*c* is relevant. Furthermore, it can be seen that once the inner and outer parts are turned in relation to each other, the control surfaces 65 and the protruding parts 43,44 will cause the toothed wheel 64 and the toothed bar 48 to disengage from each other.

Figure 6:
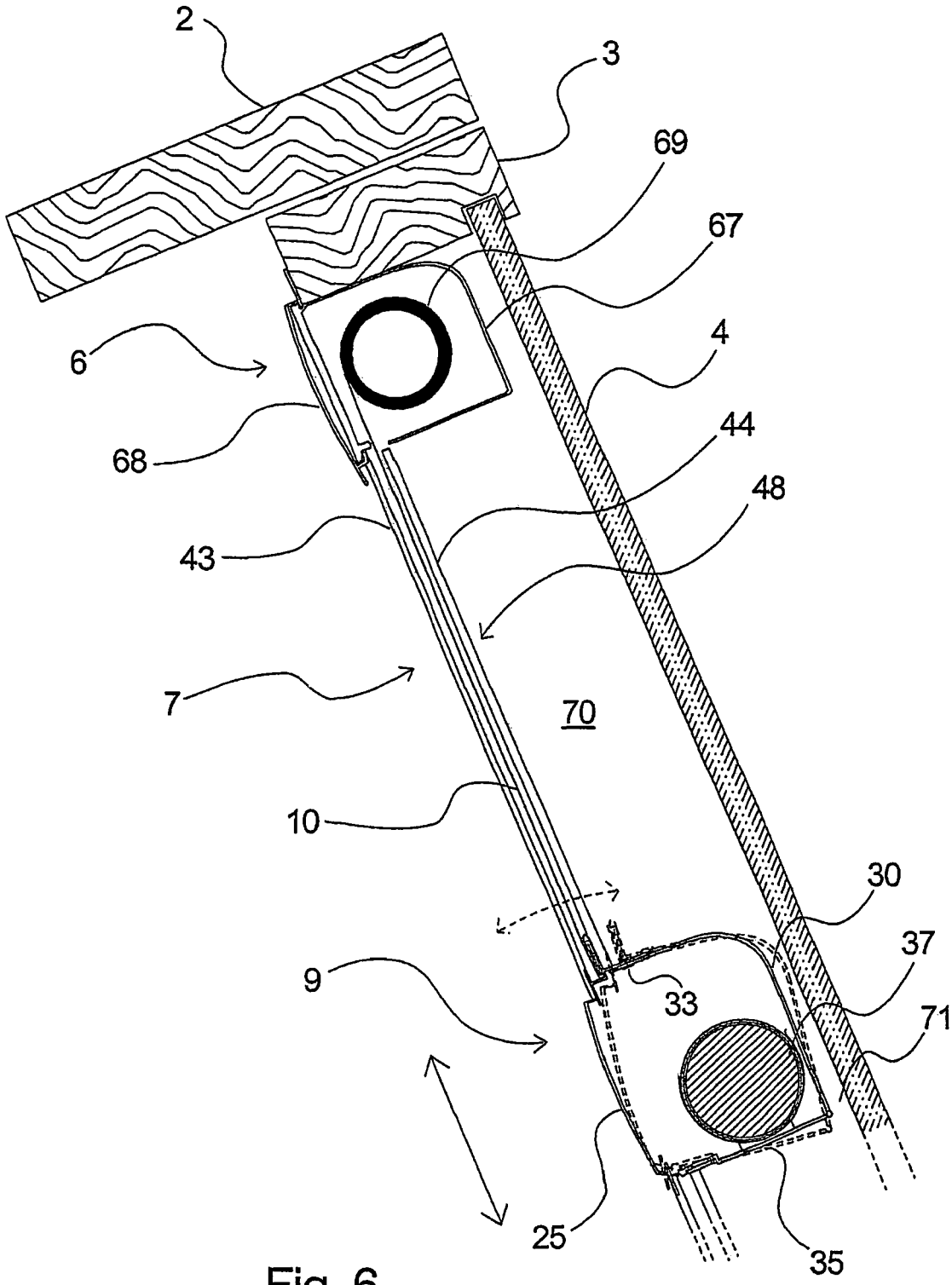
FIG. 6 is a cross-sectional side view of the window and the embodiment of the invention in FIG. 1 taken along the lines VI-VI.

FIG. 6 shows a large-scale view of a section through the upper part of a door or a window, in which a drive means 23,24 and a screening device 10 according to an embodiment of the invention have been mounted, the section showing section VI-VI in FIG. 1, with the exception of FIG. 6 illustrating a position of the bottom bar 9 closer to the top box 6 than that illustrated in FIG. 1 for reasons of clarity.

In this embodiment, the mounting is non-vertical as would be the case with e.g. a roof window or a skylight. The shown screening device 10 may be used in connection with mountings over a broad area of angles ranging from vertical to horizontal positions.

For clarity, FIG. 6 only shows specific parts of the invention and illustrates a section through a sash 2 and a frame 3. The frame 2 carries a glass pane 4 illustrated by a single-layer glass but which may naturally be any kind of known and commonly used type and nature of glass.

The upper frame 3 has been provided with a top box 6 and the side pieces of the sash have rails mounted such as, e.g., the rail 7. Furthermore, the bottom bar 9 corresponds to that of the embodiment in FIG. 3, the bottom bar 9 being illustrated in a position somewhat below the top box 6. The top box 6 is designed in a box-like configuration, which is made up by a profile rail 68 at the front, which carries or is carried by a box part 67. Inside this, a screening device 10 is rolled onto a roller 69 which may be spring-powered in accordance with prior art (not shown) so that the cloth 10 may be pulled out against spring power and so that the cloth 10 will roll back up via the spring power.

The cloth 10 extends from the roller 69 and down through a slot or opening in the housing part 67, after which it extends all the way down to the bottom bar 9 where it has been fixed to the profile part 28 (shown in FIGS. 3*a* and 3*b*) as previously explained. As shown, the edge of the cloth 10 will extend down towards the bottom bar 9 and between the protruding parts 43 and 44 of the rail 7 so that efficient screening at the sides of the screening device 10 is also obtained as previously mentioned.

The up and down movements of the bottom bar 9 will, as previously mentioned, be obtained by the drive mechanism comprising an electrical motor (or more) and a transmission mechanism via which at least one drive shaft transfers a rotating motion to the drive wheels (not shown here) which will transfer the motion to the rail 7 and especially to the side surface of the protruding part 44 and the ribbon-shaped means 48 in this particular embodiment.

Since a drive means according to the invention will often be used in connection with movements, at least partially in the direction of gravity, and/or under the influence of other forces such as spring power against which a screening device is rolled down, it should be noted that the drive mechanism will often comprise a self-locking construction. This may, e.g., be in the form of a worm gear drive, appropriately dimensioned planet gear, or other forms of locks incorporated in the drive mechanism, transmission or electrical motor etc. In this manner, the drive means will not be able to make any undesired moves, e.g., due to gravity from the position into which is has actively been brought.

Even when a drive mechanism is not provided with a self-locking construction, any manual operation by which the bottom bar 9 is sought/attempted pushed up or down in relation to the top box 6 would be impractical and difficult since the drive mechanism, transmission, electrical motor etc. must be driven due to the fact that the drive means, e.g. drive wheels 23,24, engage with the guide rails 7,8. This disadvantage may be avoided according to the invention by having a construction exemplified by the embodiment described above in relation to FIGS. 5*a* and 5*d* and it will be seen that pressure exercised on the upper part of the bottom bar 9 in the inwards direction, e.g., by affecting the operation grip 11 (not shown in FIG. 6) inwardly, will result in the function described in FIG. 5 being activated. As shown by the dotted lines in FIG. 6, the bottom bar 9 will thus rotate around a point at its lower part, whereby the drive means, including for example the drive wheels 23,24 or the toothed wheel 64, will disengage from the guide rails 7,8, and in particular from the ribbon-shaped means or the toothed bar 48. Hereafter, the bottom bar 9 may easily be moved up or down without parts of the transmission, pinion or motor etc. having to move.

Once the desired position has been located, the grip is released, e.g. the grip against the operational grip 11, after which the bottom bar 9 will resume its normal position under the influence of spring power from the return spring 57. This return movement may furthermore be encouraged by gravity, which can be seen from FIG. 6. When the point of rotation of the mutual movement between the inner 13*a*, 14*a* and outer parts 13*b*, 14*b*, is situated at the lower part of the bottom bar 9, and especially to the right in the embodiment shown in FIG. 6, the weight of the batteries, profile parts, control circuit, motor and transmission mechanisms etc. will seek to move the bottom bar 9 back to the starting point. This will be even more pronounced when the mounting in question of the drive mechanism is angled in relation to the vertical direction so that the effect of gravity will provide the greatest effect when moving back to the starting point when the issue is one of mounting in, e.g., a roof window mounted in a plane close to the horizontal. However, this means that the effect to be exercised manually must be exercised on the bottom bar 9 and/or the operation grip/handle 11 in this situation must be proportionately greater in order to be able to carry out the manual positioning of the drive means, i.e. the bottom bar 9.

Furthermore, it can be seen from FIG. 6 in connection with FIG. 5 that the profile part 63 shown in FIGS. 5*b*, 5*c* and 5*d* will have the function of holding on to the lower part of the cloth 10 which will move in the space 45 (FIG. 4*a*) at the side. Once the bottom bar 9 is tipped inwards at the top, the cloth 10 will naturally be pulled down, lead by the profile part 28 (FIG. 3). This means that the edge of the cloth 10 will be forced to disengage from the rail 7 or 8 since it would otherwise come into conflict with the protruding parts 43 and 44 of the rails 7 and 8. This is prevented by the profile part 63 which will hold the very rim of the cloth 10 inside the rail 7 or 8, i.e. the inner space 45, so that the cloth 10 will not be damaged or come loose from the rail 7 or 8 once the bottom bar 9 is tipped to manual operation.

Whether the bottom bar 9 is in its upper position or is more or less guided downwards, any light and especially sunlight coming through the glass, will hit the back, lower side and/or upper side of the bottom bar 9, whereby it will be heated. This results in an inside 9*a* of the bottom bar 9 and the parts incorporated herein, such as especially the battery 37, being exposed to heat by the incoming light. Furthermore, if the bottom bar 9 is moved away from the top box 6, a space 70 between the bottom bar 9, the cloth 10, the top box 6 and the glass 4 will emerge, in which heat generated by the incoming light falling on the cloth 10, the top box 6 and partly the bottom bar 9, will be trapped. As can be seen, the free space solely consists of a narrow passage 71 through which the heat may escape only with difficulty, especially since no form of air circulation is possible here. The narrow passage 71 is a consequence of the depth of the bottom bar 9 which has to be sufficiently deep to accommodate a battery pack 21, among others, and due to the fact that the depth of the sash 3 will determine how far from the glass 4 the bottom bar 9 may be placed in the construction.

All in all, this means that the inside 9*a* of the bottom bar 9 and in particular the inner power supply unit 21 with the battery 37 will be exposed to fairly high temperatures.

In order to overcome this problem the encapsulating plate 30 has been designed in such a manner that it is capable of leading heat energy from both the inner space 9*a* in the bottom bar 9 and from the inner space 70. The encapsulating plate 30 may thus be designed in a material with relatively good heat-conducting properties such as, e.g., aluminum. As has been explained previously, the encapsulating plate 30 is mounted to the upper part of the plate or rail part 25, e.g., via riveted joints 33 or similar mechanisms by which heat energy may be conducted to the plate or rail part 25. Furthermore, an appropriately large overlap between the encapsulating plate 30 and the part (32; FIG. 3*a*) of the plate or rail 25 to which the encapsulating plate 30 is connected may be made so that good heat conduction may be obtained.

The heat energy may thus be transferred to the plate or rail part 25 facing free space, i.e. a room, a living room or a similar room, in which the temperature will be relatively low compared to the temperature in the space 54, on the surface of inside 9*a* the bottom bar 9, and especially the power supply unit 21. The heat energy will thus be conducted from the plate or rail part 25 which will feature a relatively large heat-dissipating area since it extends in the entire length and height of the bottom bar 9. Furthermore, this effect may be enhanced by the plate or rail part 25 being designed in a material with good heat-conducting properties such as e.g. aluminum, just as the surface of the plate or rail part 25 may be designed with respect to particularly good heat-dissipating properties such as ribs, black surface etc.

With the embodiments described above, tests have shown that the temperature inside the power supply unit 21, and therefore also the temperature of the battery pack, may be reduced significantly, e.g. by as much as approx. 10° C., in comparison with known constructions that have not been designed in accordance with the invention. This will result in a considerable extension of the effective operating time of a given battery pack 21 since the amount of energy to be drained from a battery pack 21 is reduced significantly at relatively high operating temperatures. Thus, it will often be the case with known constructions that the temperatures in a space between a screening device 10 and the glass may exceed 80-90° C. which, in turn, will lead to a correspondingly high temperature in a power supply unit 21 with such a construction. In connection with the invention, the operating temperatures for the battery pack 21 are reduced to levels ensuring long durability, e.g. an effective operating time in excess of a year, when using four type D batteries 37 at a specified operational need of an average of two operating cycles (one roll-down and one roll-up every day).

Figure 7A:
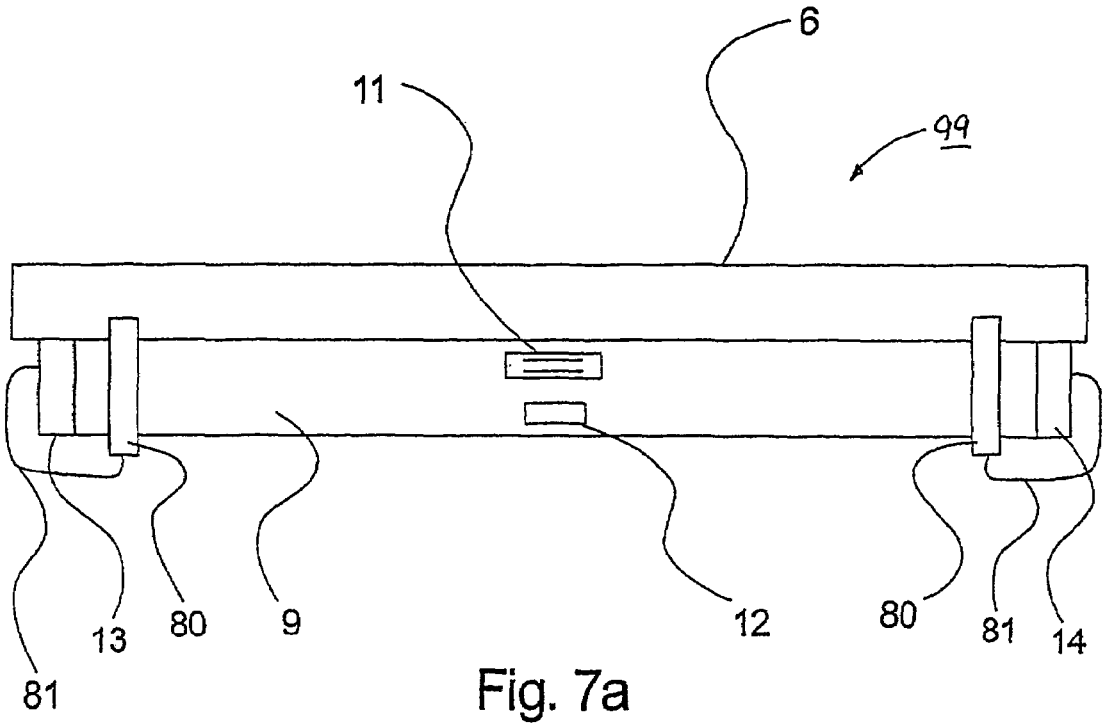
FIG. 7*a* is a front elevational view of an embodiment of the invention particularly showing a fitting according to the invention.

Yet another advantage of the invention will be described in the following with reference to FIG. 7, in which FIG. 7*a* shows a top box 6 and a bottom bar 9 as they would be delivered to the user for retrofitting in, e.g., a window. In order to ease the mounting, these two parts have been tied together as a kit 99 via transportation fittings 80 which may be arranged near each end as illustrated. These transportation and/or mounting fittings 80 will, as will be described in detail, hold the top box 6 and the bottom bar 9 together while the top box 6 is mounted in, e.g., the window, for example via fittings not illustrated and mounted in the window beforehand. Once the top box 6 has been mounted, the guide rails 7,8 or the like, by which the bottom bar 9 may be moved up and down, may be mounted in the window, possibly also by non-illustrated fittings, e.g., at the lower part of the window, by positioning the rails or the like in the upper part via the top box 6 and at the same time brought to engage with the means 13 and 14 for cooperation with the rails 7,8. Hereafter, the transport fittings 80 may be dismounted and the operating device may principally be put into use.

However, problems may arise during mounting of the guide rails 7,8 or the like once these have to be brought to engage with the means 13 and 14 for cooperation with the rails 7,8, since the power-transmitting connection may result in resistance, especially where self-locking mechanisms are concerned, whereby mounting will practically be impossible. In order to overcome this problem, transportation fittings 80 according to the invention feature an additional obstructing part shown in FIG. 7*a*, which is mounted at a connecting, part 81 and which will be described in detail with reference to FIG. 7*b*.

Figure 7B:
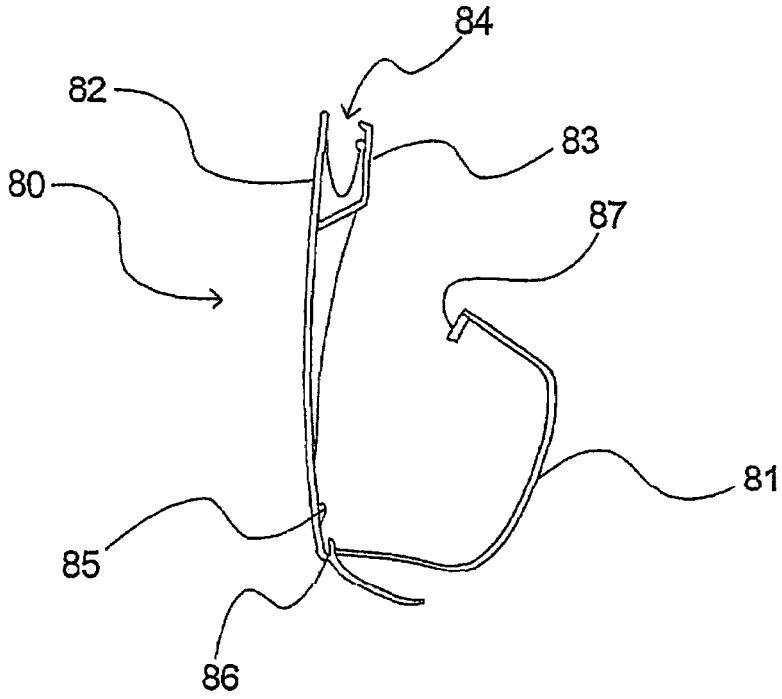
FIG. 7*b* is a side elevational view of the fitting as in FIG. 7*a*.

FIG. 7*b* shows the transportation and mounting fittings 80 from the side and it can be seen that one end has been provided with jaws 82 and 83 which together define a clamping gap 84 capable of capturing and fixing the lower edge of the front side of the top box 6, e.g., the plate or rail part 68. The other end is provided with clamping means 85 and 86 which together are capable of capturing the lower part of the front side of the bottom bar 9, e.g. the plate or rail part 25, so that the bottom bar 9 and the top box 6 are held together.

As shown, the connecting part 81 is connected to an obstructing pin 87 designed in such a manner that it may be positioned in the outer parts 13*b* or 14*b* of the means 13 and 14 for cooperation with the rails 7,8 so that these parts will be locked in a position in which manual operation is possible. It will be possible to position the obstructing pin 87, as can be seen from FIG. 5*d*, in the part of the slot 59 which is accessible once the inner 13*a* and the outer 13*b* parts are twisted in relation to each other against the spring force of the spring 57. Afterwards, the inner and outer parts 13*a*,13*b* will be fixed in the position allowing for manual operation and in which a guide rail may be mounted in the means 13 or 14 for cooperation with the rails 7,8 without problems.

The transportation and mounting fitting 80 will be placed in the position by the supplier. Once both the top box 6 and the guide rails 7,8 have been mounted, the fitting(s) 80 may be removed, including the obstructing pin 87, after which the outer part 13*b* or 14*b* will retract to the position in which the drive means 23,24 or 64 will engage with the rails 7 and 8 so that the operating device will be ready for operation.

The transportation and mounting fitting 80 may be manufactured in an appropriate plastic material and may thus advantageously be manufactured in one single coherent piece by, e.g., a molding process.

Figure 8:
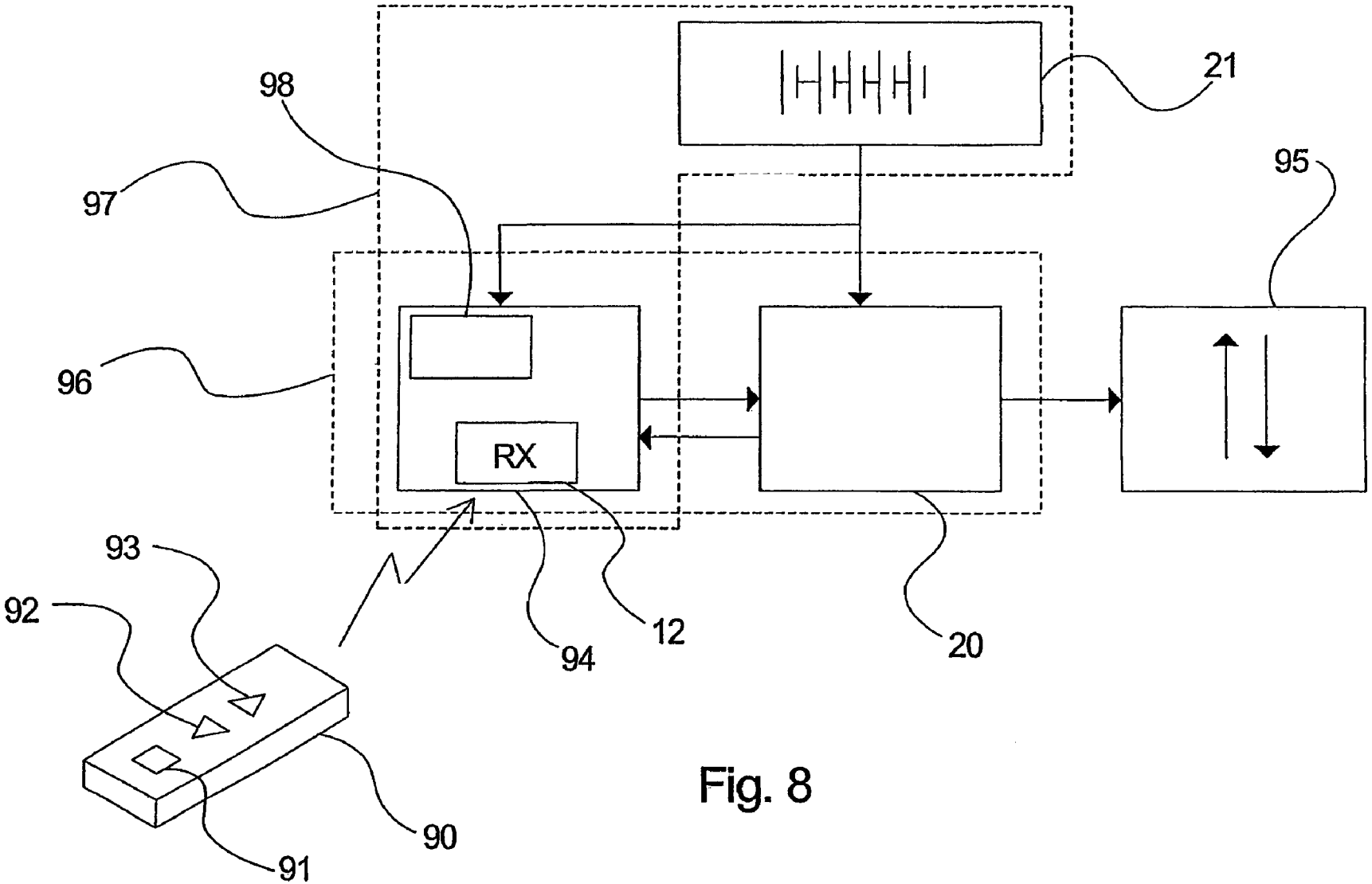
FIG. 8 is a schematic view of a power supply and control circuit according to another aspect of the invention.

Another aspect of the embodiment of the invention whereby the effective operation time of a given power supply unit may be increased will be explained in detail in the following with reference to FIG. 8 showing an example of a power supply and control circuit incorporated in a drive means and/or an screening device 10 according to the invention.

As illustrated, control of the drive means may take place via a remote control 90 of the known kind with operational buttons, e.g., a button 91 for stopping an ongoing movement of the drive means, a button 92 for moving the drive means in one direction and a button 93 for moving the drive means in another direction.

As previously mentioned, the signals are received from a remote control 90 by a receiver 94 which may be designed as part of the control circuit generally referred to as 94. From here, the corresponding signals are sent to a drive mechanism 20, meaning one or more electrical motors, e.g., DC motors and associated transmission mechanisms, gearings etc. The movement is then transferred via mechanical transmission generally referred to as 95 and which comprises drive shaft(s), drive means, including e.g., drive wheels 23,24, and rails 7,8 or similar constructions to which the driving force is transferred.

From the power supply unit 21, which may preferably comprise one or more batteries 37 as already mentioned, e.g. in the form of a battery pack, power is led to the drive mechanism/electrical motor 20 and to the control circuit 94. It is also possible to only have a power supplying connection from the power supply unit 21 to the control circuit 94, from which the energy supply is then led to the drive mechanism/electrical motor 20. As shown, feed-back to the control circuit 94 may take place from the drive mechanism/electrical motor 20 which may comprise a signal indicating the motor current which may be used for detecting when the drive means have reached an end stop in the form of e.g., a bottom stop or a top stop or of detecting that the drive means has been blocked or is somehow not operating normally, after which the control circuit may react accordingly, e.g., by stopping the movement of the drive means or any attempt to move.

As illustrated by 96, the control circuit may actually be physically incorporated in or mounted on/next to the drive mechanism 20, or it may, as also illustrated by 97, be incorporated in or mounted on/next to the power supply unit 21, e.g., in the free space, which will be present in the space defined by the plate or rail part 25 shown in FIG. 3, the encapsulating plate 30 and the bottom flap 35. Other possible mounting methods will naturally also be possible, just as it will be apparent that the control circuit may comprise more units, which may be appropriately positioned.

Furthermore, the control circuit 94 comprises a functional part 98, an energy saving circuit serving to limit energy consumption by the drive means, consumption of idle energy and thereby also the stand-by loss. Normally, the control circuit will be in a mode in which it will be ready for immediate reaction to a received signal from the remote control 90 so that the drive means will react quickly. Via the functional part 98, the control circuit 94 will shift into a resting mode, a "sleep mode" when a predetermined amount of time shows no activity in relation to the drive means, in which power consumption is significantly reduced, e.g. by making certain control and measuring circuits powerless. The energy saving circuit 98 will comprise a timer function so that activation of the receiving circuit (12) takes place in a brief interval Tw at a predetermined periodicity of the period T in order to determine whether a control signal is transmitted from the remote control 90. If so, the energy saving circuit 98 will initiate start-up of the other necessary functions in the control circuit 94 and potentially the drive mechanism 20.

By applying such an energy saving circuit 98, it will be advantageous to design the remote control in such a manner that transmitted signals will be of a certain minimum duration, Tmin, and to design the energy saving circuit 98 in such as manner that during the period of time, Tmin, it comprises at least one of the time intervals in which control for received signals is made. Thus, Tmin will be greater than or equal to T, whereby it is ensured that any signal transmitted from the remote control 90 will lead to action.

As mentioned, the energy saving circuit 98 may be designed in such a manner that it shifts into resting mode or "sleep mode" following a certain period of inactivity. Alternatively or simultaneously, the energy saving circuit 98 may be designed in such a manner that it shifts into resting mode during certain times of day, e.g., at night. Furthermore or alternatively, it is possible to design a storage unit in relation to the circuit for storage of activation times and potentially the frequency of activations for the past couple of days, weeks etc. so that the energy saving circuit may be designed to assume a resting mode of short or long periods of time during which no previous activities have been carried out.

Other possibilities for control inputs for the energy saving circuit may be applied as well. The room may be provided with a sensor or a similar circuit capable of detecting human presence, e.g., in the form of a movement sensor, so that the resting mode will only be assumed when no presence of persons is detected, possibly for a certain predetermined period of time. In a similar manner, it would be possible to picture an intelligent (activity learning) system capable of adjusting/controlling screening devices independently on the basis of various sensor registration parameters (pressure, temperature, light intensity, etc.); naturally, with the possibility of manual operation.

In the foregoing discussion, the invention has been described in relation to a specific example, in which a screening device has been designed in such a manner that it may be mounted in relation to existing building openings, windows, doors or the like, only requiring mounting of a top box which is held together with a bottom bar during mounting and with two side rails being mounted and fixed to the building opening, the window or the like. Immediately hereafter, the screening device make be put into use, potentially following the insertion of batteries.

Meanwhile, the invention may be used in other connections. Thus, the invention may be used in connection with ready-made constructions featuring a top box and/or side-guiding surfaces which have not been incorporated/mounted beforehand in the window or door instead of separate drive rails.

Furthermore, a drive means according to the invention may be used in other respects as it may, e.g., hold other objects such as light screens in connection with transparent roof surfaces, in connection with green houses etc, and basically anyplace in which a drive means is needed for parallel guidance or if exposed to great heat impacts with damaging and/or negative consequences resulting therefrom.

Thus, the drive means may be used to hold/pull other than cloth materials. For example, windows and doors may involve Venetian blinds to be pulled up and down by the drive means. Also, curtains to be folded via "winding/coiling" may be relevant, as will insect screens etc.

Furthermore, it should be mentioned that the foregoing description refers to a plate or rail part 25 and it must be understood that this includes any kind of shape by which it may serve to conduct heat from the back of a unit comprising a power supply etc. to the front or an area around the front from which the heat may be led to a cooler medium such as the air. Thus, the plate or rail part 25 does not have to extend in the entire length and/or height of the bottom bar 9, just as it does not have to be a continuous body. Furthermore, it may be composed from several subjects, which are connected in a heat-conducting connection.

Finally, it should be noted that the previously mentioned heat-conducting connection between the plate or the rail part

25 and the encapsulating plate 30 is exemplified by an overlap between the two subjects and a mechanical connection via rivets or the like. Other forms of connections may also be applied such as screw connections, welding, soldering or similar connections, deformation connections and/or adhesive connections. Furthermore, it is apparent that the distance between, e.g., spot-wise connections may be varied with respect to the specific circumstances and the desired heat-conducting properties, just as the number and the dimensions of such connections may be varied according to the needs. A potential overlap between the two subjects may also be varied and additional heat-conducting means such as heat-conducting paste etc. may be used depending on the planarity and/or the roughness of the two subjects.

Moreover, references herein to "top", "bottom", "side", "lower" and "upper" structures, elements and geometries and the like are intended solely for purposes of providing an enabling disclosure and do not suggest limitations regarding the operative orientation of the innovation or any components thereof. Thus, it will be apparent to those skilled in the art that various modifications and variations can be made in the present invention without departing from the scope and spirit of the invention. It is intended that the present invention include such modifications and variations and their equivalents.

The invention claimed is:

1. A screening device for positioning a screening material, comprising:

a moveable drive apparatus for moving a screening material from proximate a first position to proximate a second position, the moveable drive apparatus including a drive mechanism in a first or a second state and an encapsulating part, the moveable drive apparatus being configured to be manually or automatically adjustable to the first and second positions, or to a desired position therebetween, at least a portion of the encapsulating part being disposed about and connected to at least a portion of the drive apparatus, wherein the moveable drive apparatus, when manually adjusted, is configured to disrupt a power-transmitting connection with the drive mechanism thereby changing the drive mechanism from the first state to the second state and wherein the drive mechanism is adjusted from the first state to the second state by disengaging a drive wheel of the drive mechanism from a guide rail of the screening device.

2. The screening device as in claim 1, further comprising a spring device configured to urge the drive mechanism to return to the first state when the drive mechanism is in the second state.

3. The screening device as in claim 1, further comprising means for driving the moveable drive apparatus and a plurality of guide rails, the means for driving configured to supply power to at least one of the guide rails.

4. A method of operating a screening device to position a screening material, the method comprising the steps of:

adjusting a screening material with a moveable drive apparatus from proximate a first position to proximate a second position, the moveable drive apparatus including a drive mechanism in a first or a second state and an encapsulating part, the moveable drive apparatus being adjustable to the first and second positions, or to a desired position therebetween, at least a portion of the encapsulating part being disposed about and connected to at least a portion of the drive apparatus; and manually adjusting the moveable drive apparatus to disrupt a power-transmitting connection with the drive mechanism, thereby changing the drive mechanism from the first state to the second state; and adjusting the drive mechanism from the first state to the second state by disengaging a drive wheel of the drive mechanism from a guide rail of the screening device.

5. The method as in claim 4, further comprising the step of urging the drive mechanism by a spring device to return to the first state when the drive mechanism is in the second state.

6. The method as in claim 4, further comprising the step of driving the drive apparatus by supplying power to a guide rail connected to the drive apparatus.

7. The method as in claim 4, further comprising the step of conducting heat from the drive apparatus by one of a rivet connection, a screw connection, a welded connection, a solder connection, a deformation connection, and a heat conducting paste connection.

* * * * *